United States Patent [19]

Santucci

[11] Patent Number: 4,909,398

[45] Date of Patent: Mar. 20, 1990

[54] MAGAZINE FILE SYSTEM

[76] Inventor: Donald G. Santucci, 1154 Avenue Leprovence, Naperville, Ill. 60540

[21] Appl. No.: 198,322

[22] Filed: May 28, 1988

[51] Int. Cl.[4] ..... A47F 7/00

[52] U.S. Cl. ..... 211/50; 211/11

[58] Field of Search ..... 211/50, 194, 40, 42, 211/126, 11, 184, 43; 312/107, 108

[56] References Cited

U.S. PATENT DOCUMENTS

| | | | |
|---|---|---|---|
| 1,414,130 | 4/1922 | Hislop | 211/11 |
| 1,726,121 | 8/1929 | Polkosnik | 312/107 X |
| 3,592,344 | 7/1971 | Schade | 211/50 X |
| 3,759,395 | 9/1973 | Juhlin | 211/50 X |
| 3,870,156 | 3/1975 | O'Neill | 211/11 X |
| 3,899,228 | 8/1975 | Schreiber | 312/107 X |
| 4,239,306 | 12/1980 | Klaus | 312/108 X |
| 4,714,165 | 12/1987 | Solomon | 211/184 X |

*Primary Examiner*—Alvin C. Chin-Shue
*Assistant Examiner*—Sarah A. Lechok
*Attorney, Agent, or Firm*—Hill, Van Santen, Steadman & Simpson

[57] ABSTRACT

A magazine or paper rack storage system including one or more interconnectable racks, the rack system being mountable in any of three independent orientations. Each rack comprises two side panels, a base panel and a back panel. One side panel has an opening therein which permits the viewing of items in the rack and the placement of items in the rack when such is oriented as a tray. The other side panel covers a larger area thereby serving as the bottom of the rack, again, when the rack is positioned as a tray. A rack interconnection arrangement includes a pair of spaced integral slots on the base panel in combination with interconnecting spline members. The slots include a ridge to provide a friction three-point engagement with the spline. The rack interconnection arrangement further includes a tab fitted into slots which slots are located generally within the side panels at positions spaced from the bottom panel.

8 Claims, 2 Drawing Sheets

MAGAZINE FILE SYSTEM

This invention relates to magazine racks and more specifically to a couplable, interconnecting magazine rack/letter tray unit which, when interconnected to one or more like units, is stable in three dimensions thereby facilitating its use as a magazine rack in either of two vertical orientations, or, as a letter tray in a third, horizontal orientation.

Magazine racks and letter trays of both the interconnecting and non-interconnecting variety are well known in the art. The present invention relates to racks of the interconnecting variety and, more specifically, to an inexpensive, yet stable, rack and rack interconnection system which facilitates use of the rack in any of three orthogonal orientations either as a rack or, alternatively, as a tray.

One known interconnecting rack employs mating tongues and grooves along opposite, but parallel, sides of the rack base members. In this way, multiple racks can be interconnected by inserting the tongue of one rack into the groove of an adjacent rack. Such magazine racks are undesirable, however, because they tend to be more expensive to fabricate and, more significantly, their single line of interconnection or attachment limits use of these racks to a corresponding single orientation in which the tongue and groove must be positioned along the bottom of the rack, parallel to the desk-top. Further, the vertical side members of known tongue and groove racks are affixed in cantilever fashion to the base members and, therefore, are known to exhibit substantial flexure—to the point of failure.

Letter trays are also known that interconnect to effect stacking. Such trays generally employ a slot-and-tab arrangement to effect attachment. In one such tray, an L-shaped tab is inserted vertically into a mating slot, then, the trays are slid laterally, relative to one-another, to complete the locking engagement. Other arrangements, for example snap fit tabs and slots, are also known.

These known slot and tab trays lack the rigidity and sure-locking capability of the magazine rack/letter tray of the invention. Such trays may be accidently uncoupled by jostling or jarring motions, which cause the tab to disengage. Snap-fit interconnections are likewise undesirable for a strong and reliable, detachable interconnection. Inherently, the material used for the snap-fit mechanism must be able to deform partially to allow engagement. A similar force in the opposite direction could accidentally disengage the units.

But as importantly, these prior art stacking and interlocking arrangements fail to provide the present multiple point attachment system wherein rigidity and stability are provided in each of three independent planes thereby permitting use of the interconnected rack structure in any of three orthogonal orientations. Thus, the present multifunctional magazine rack and desk tray advantageously provides a strong, stable, easy-to-assemble/disassemble system which is also inexpensive to manufacture. Moreover, said magazine rack/letter tray is functional as a magazine rack in two orientations and may be used side-panel-down as a letter tray.

DESCRIPTION OF THE PREFERRED EMBODIMENT

Figure 1:
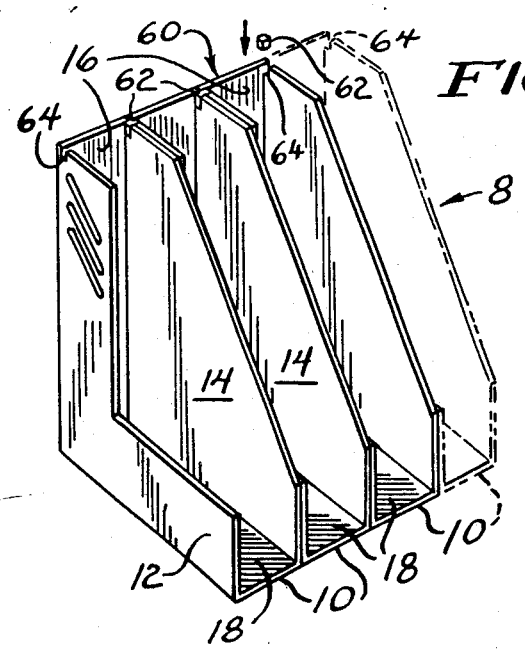
FIG. 1 is a perspective view showing four interconnected racks of the present invention oriented in a vertical upright position.
Figure 2:
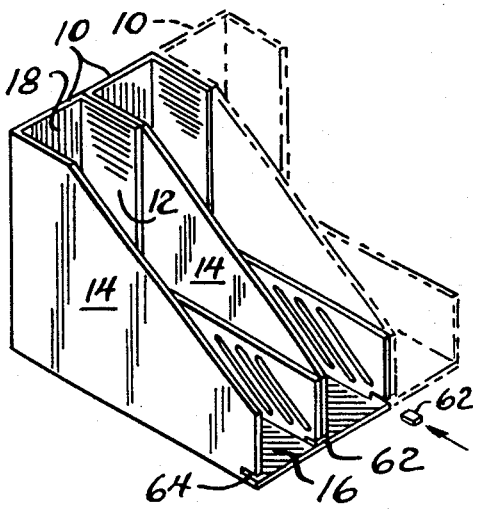
FIG. 2 is another perspective view showing three interconnected racks of the present invention oriented in an alternative upright position.
Figure 3:
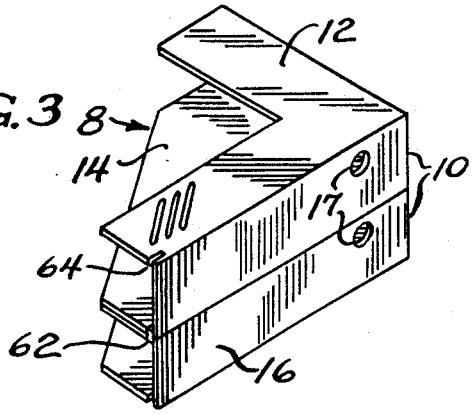
FIG. 3 is yet another perspective view showing two interconnected racks of the present invention oriented in a second alternative position wherein the racks function as trays.

FIGS. 1–3 illustrate the interconnectable magazine rack/letter tray assembly 8 of the present invention in each of three alternative orientations. Each assembly 8 is comprised of one or more interconnected racks 10 which function as a convenient means for storing or filing magazines or other papers. Racks 10 may therefore be advantageously dimensioned according to the specific application intended. For use as a magazine rack for example, and with specific reference to FIG. 1, each rack 10 is approximately 12 ½ high, by 9 ½ inches deep, by 3 inches wide.

Thus, rack 10 may function as a vertical magazine rack, shown in FIG. 1; as a horizontal magazine or paper rack, illustrated in FIG. 2; or, as a paper tray, depicted in FIG. 3. As explained in more detail below, this multiple orientation flexibility of the present rack is obtained through the combination of the rack design, including the respective shapes of the individual panel members defining the rack, and the three point rack interconnect system.

It will be further appreciated that racks 10 may be utilized in any of the depicted orientations either individually, or interconnected with an arbitrary number of other racks 10. Thus, FIGS. 1–3 depict 4, 3, and 2 interconnected rack assemblies, respectively.

With continuing reference to FIGS. 1–3, each rack 10 includes first and second side panels 12 and 14, respectively, spaced apart in parallel relationship by back panel 16 and base panel 18. It will be appreciated that the use of terms "side", "base", and "back" in connection with the present discussion of rack 10 reflects the nominal magazine rack orientation of FIG. 1 and that the actual position or orientation of these respective panels will change for each of the alternative orientations depicted in FIGS. 2 and 3. For example, the second side panel 14 of FIG. 1 effectively functions as the bottom panel when the rack is oriented as the tray of FIG. 3.

Although the side panels 12, 14 may be of any shape, in the preferred embodiment one of the side panels, for example the first side panel 12, is L-shaped while the other side panel, e.g. the second side panel 14, is triangularly or pentagonally-shaped. These shapes provide an aesthetically pleasing design while simultaneously achieving important functional requirements.

The L-shaped side panel 12 provides a relatively large open area generally through the middle of the panel thereby permitting the user to see a substantial area of, for example, a magazine cover (FIG. 1) or the contents of the rack when used as a tray (FIG. 3). This opening further facilitates the placement and removal of papers from the rack, again, when it is oriented as shown in FIG. 3 as a tray. The pentagonal side panel 14, on the other hand, provides additional structural integrity to the rack while, importantly, serving as the paper-retaining bottom of the tray of FIG. 3.

Figure 12:
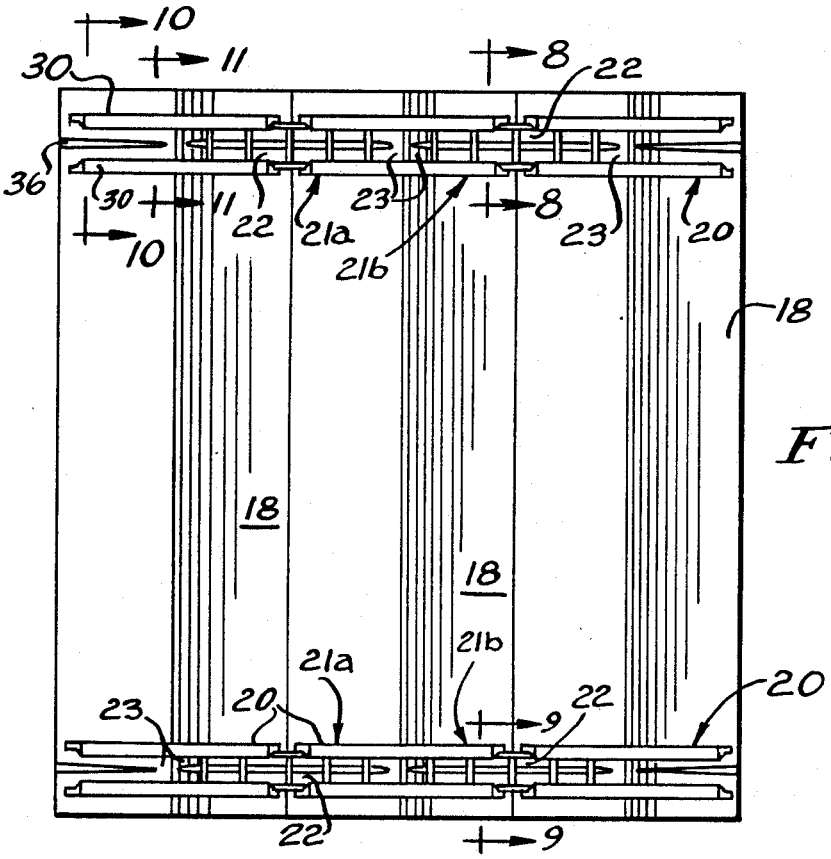
FIG. 12 is a bottom horizontal view of three of the four interconnected racks of FIG. 1; and, FIG. 13 is a fragmentary top horizontal view of three of the four interconnected racks of FIG. 1.

The back panel 16 is provided with a small opening 17 to facilitate the removal or 'pushing out' of magazines from the rack particularly where, as often occurs, too many items have been placed therein. A pair of C-shaped slots 20 are integrally formed in spaced relationship along the outside surface of base panel 18. (FIG. 12). As explained in more detail below, slots 20 perform a dual function, first, as feet where the rack is oriented in its upright position (FIG. 1) and, second, as one member of a slot/spline rack interconnection assembly.

As illustrated in FIGS. 1–3, multiple racks 10 may be interconnected to provide larger magazine and paper file assemblies. An important feature of the present invention is the multi-point rack interconnection arrangement which, when combined with the above described versatile rack design, provides a strong, stable file system adapted for use in any of three independent and orthogonal orientations.

More specifically, in the preferred arrangement of the present multi-point rack interconnection system, a pair of rack interconnect fastening means are positioned in spaced relationship along the base panels 18 of each rack while a third interconnect fastening means is positioned generally at the opposed vertex, that is, at the top of the rack when viewed as oriented in FIG. 1. Each of these interconnecting means will hereinafter be discussed in detail.

As best shown in FIG. 12, the base panel interconnecting means comprises four slot/spline mechanisms 21—two, 21*a*, being oriented to engage a rack placed adjacent the first side panel 12 and two, 21*b*, being similarly oriented with respect to the second side panel 14. Thus, two points of interconnection are provided along the base panel 18 for attachment of any given adjacent rack 10.

The slot/spline mechanisms 21 of the present invention, as shown in FIGS. 4–12, include a spline member 22 and a pair of juxtaposed slots 20, one each on respective adjacent racks 10. Each slot/spline mechanism 21 utilizes a three-point friction fit that provides a strong but reversible union between the spline 22 and its mated slots 20. As set forth in more detail below, the present three-point slot/spline mechanism is particularly suited for use with plastic injection molded techniques, where the dimensional tolerances of molded parts are generally less precise than with known alternative fabrication technologies.

Thus, the tolerance variations of a molded slot/spline mechanism not incorporating the present three-point friction engagement arrangement may result in a spline which is too large to engage the intended slot or, conversely, a spline which is too small to effect a tight frictional fit within the slot.

Rack 10 and spline member 22 are preferably molded of a polystyrene or other suitable and relatively inexpensive plastic material. Slots 20 are integrally formed on the base panel 18 during the molding of rack 10 which, in turn, is preferably molded as a single piece or unit utilizing a split die and core member (not shown). The split die generally defines the outside finish and contour of the rack while the core member forms the substantially rectangular inside contour. A negative draft may be provided in the die, in particular along the base panel centerline, to facilitate removal of the rack from the die after molding.

The three-point slot/spline arrangement of the present invention serves two important functions with respect to the use of inexpensive plastic molded parts. First, as outlined in more detail below, normal plastic part tolerances may be accommodated by reason of the self-adjusting capability of the present three-point design. Second, as it is well known that parts made of like material may exhibit a relatively high coefficient of friction at their mating surfaces, the three-point spline/-slot arrangement of the present invention controls and limits the contact between the spline 22 and slot 20 thereby facilitating a predetermined and repeatable frictional interaction therebetween.

Figure 10:
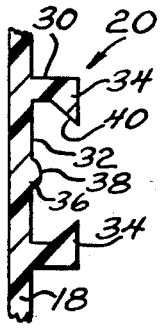
FIG. 10 is a sectional view of the spline retention slot taken along a line 10—10 of FIG. 12 generally at the spline entrance to the slot.
Figure 11:
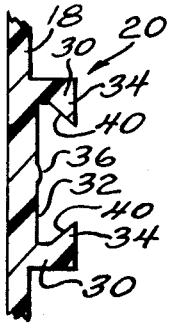
FIG. 11 is another sectional view of the spline retention slot taken along a line 11—11 of FIG. 12 generally at a position spaced inwardly of the spline slot entrance.

As best shown in FIGS. 10 and 11, slots 20 are defined by a pair of opposed parallel walls 30 extending upwardly from a substantially flat floor 32 defined by the outer surface of the base panel 18. Each wall 30 includes an inwardly facing lip 34 along the top thereof. A ridge 36, oriented generally along the longitudinal centerline of slot 20, extends upwardly into the slot from the slot floor 32. The uppermost extension of ridge 36, shown at 38, defines the first of three spline contact points. As discussed in more detail below, the remaining two spline contact points are defined along the inwardly facing surfaces 40 of respective wall lips 34.

The height of ridge 36, as measured relative to the slot floor 32 may advantageously be tapered along the longitudinal axis of the ridge and slot to effect more controlled frictional spline insertion and contact forces. More specifically, the ridge may be tapered from its maximum height at the entrance to the slot (FIG. 10) to a lower height away therefrom (FIG. 11).

It will be appreciated that the above described tapered ridge provides a maximum spline-to-slot frictional engagement (per unit length) at the entrance to the slot, that is, upon initial insertion of the spline. This use of a contoured frictional engagement force may be advantageous in controlling the maximum frictional force required to insert the spline into the slot by reason that this arrangement lessens the overall frictional force which force would otherwise increase linearly as the spline is inserted into the slot. In the preferred tapered arrangement of the present invention, the frictional forces continue to increase upon the progressive insertion of the spline, but at a non-linear rate less than that associated with a uniformly cross-sectioned slot/ridge combination. A contoured ridge 36 may also be used to compensate for the negative draft of base panel surface 32. Finally, the cross-section of each slot may advantageously be restricted at the interior limits 23 thereof to correspondingly limit the maximum insertion of splines 22 into slots 20.

Figure 6:
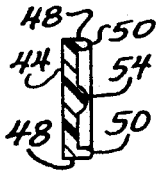
FIG. 6 is a sectional view of the spline member taken along line 6—6 of FIG. 4.
Figure 4:
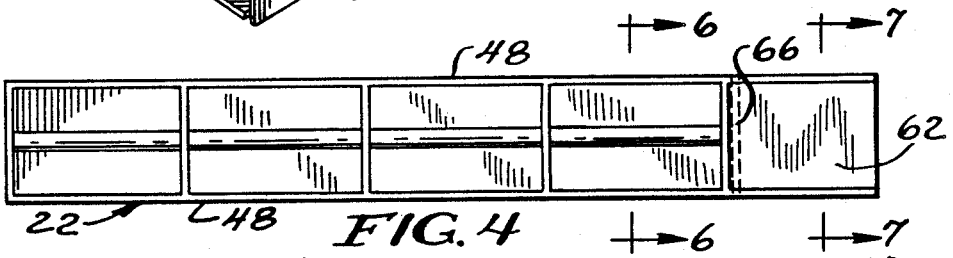
FIG. 4 is a top horizontal view of the interconnecting spline member with removable tab member connected thereto.
Figure 5:
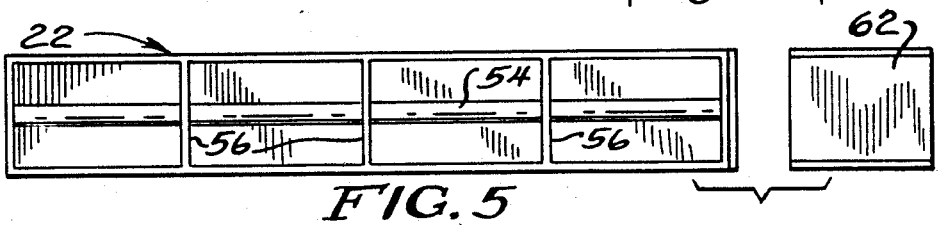
FIG. 5 is a top horizontal view of the interconnecting spline member of FIG. 4 with the tab member separated therefrom.

FIGS. 4, 5 and 6 illustrate the spline 22 of the slot/-spline rack interconnection mechanism 21. Spline 21 is a rigid, elongate batten-like structure, suitably sized to fit into slot 20 to effect, as discussed in more detail below, the three-point friction engagement therein. While spline 22 is designed to remain substantially rigid during insertion, the spline must nonetheless exhibit sufficient elastic properties to permit the bilateral deformation around its longitudinal axis as required to compensate for normal molding tolerances (see FIG. 9).

Spline 22 defines a generally flat lower surface 44 adapted to be slidably engaged by the slot ridge 36 thereby defining the first of the three slot/spline contact points. This first contact point is shown at 46 in FIGS. 8 and 9.

A pair of rails 48 are formed along the outside longitudinal edges of spline 22. Rails 48 extend vertically upwardly from the spline and define corresponding bevelled contact surfaces 50. Spline surfaces 50 are spaced to slidingly engage the slot wall surfaces 40 thereby defining the second and third spline-to-slot contact points 52 as shown in FIGS. 8 and 9.

As best illustrated in FIG. 5, spline 22 may optionally be reinforced with a longitudinal ridge 54 and/or a plurality of lateral ribs 56 to provide torsional rigidity during spline insertion thereby insuring the required spline integrity and proper frictional engagement.

As noted, spline 20, in particular the size and spacing of the vertical rails 48 thereon, is suitably dimensioned to insure three-point engagement with slot 20. Thus, the nominal dimensions of the slot and spline are selected such that the spline will, regardless of tolerance various, frictionally engage the slot at the previously described three points 46 and 52.

Figure 8:
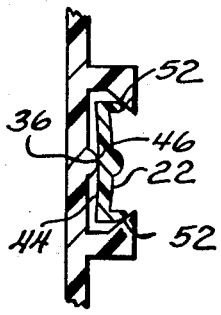
FIG. 8 is a sectional view of the spline member position in the rack slot, taken along line 8—8 of FIG. 12, representing the a minimal interference fit therebetween.
Figure 9:
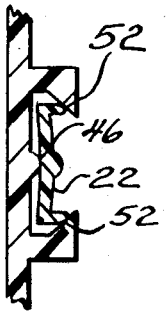
FIG. 9 is a second sectional view of the spline member positioned in the rack slot, taken along line 9—9 of FIG. 12, but representing a greater interference fit therebetween

FIG. 8 illustrates the nominal relationship between the spline and slot wherein the spline is slightly deformed as it is inserted into the slot. Thus, the overhanging lips 34 of the slot walls 30, acting upon the respective spline rails 48, force the spline downwardly (to the left as viewed in FIGS. 8 and 9) against the center slot ridge 36 thereby causing the above described deformation of the spline. FIG. 8 generally represents the interaction between spline and slot where dimensional tolerances result in the minimum of engagement therebetween. It is, in short, a requirement that the spline and slot be dimensioned to insure slight deformation even where, due to tolerance variations, the spline is at its smallest size limit relative to the slot.

FIG. 9 represents the spline-to-slot engagement where expected part tolerance variations cause a greater engagement between these respective pieces. As illustrated, spline 22 deforms somewhat more about its longitudinal axis to compensate for the increased interference with the slot. It will be seen that the present three-point engagement system permits greater part tolerance variations than would otherwise be possible with more conventional slot/tab configurations. This increased flexibility is afforded by the automatic compensation provided by the corresponding deformation of the spline member.

Figure 13:
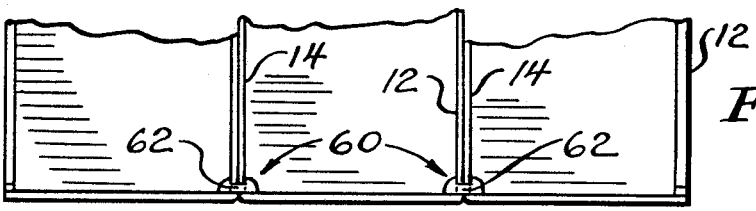

As previously discussed, an important aspect of the present invention relates to the rigid and stable interconnection of multiple magazine racks/letter trays whereby the interconnected racks may be oriented in any of three orthogonally independent planes. To facilitate the required structural integrity, a third interconnect fastening means is provided, as best illustrated by FIG. 13, generally at the upper portion of the rack 10 (as viewed in FIG. 1). Thus, the required structural integrity is provided by the cooperative action of two slot/spline mechanisms 21 along the base panels 18 and the upper latching arrangement to be described hereinafter.

It will be understood that the upper rack attachment mechanism should desirably effect attachment in an unobtrusive manner, that is, where the means for attachment detract minimally from the aesthetics of the overall rack structure. Unlike the slot/spline arrangement previously considered, wherein the slot performs in an additional aesthetic and functional capacity i.e. as rack feet, the upper attachment mechanism performs no such additional function. It will be seen, however, that the present upper tab/notch latching assembly 60 defines an inexpensive, effective, and unobtrusive latching structure.

Referring to FIG. 13, the upper latching assembly 60 includes a winged tab 62 adapted to engage and interconnect contiguous side panels 12 and 14 associated with respective adjacent racks 10. More specifically, tab 62 is inserted into vertical notches or slots 64 (FIG. 1) provided at predetermined points along the top of each side panel 12 and 14, preferably where the side panels intersect back panel 16.

As will be observed by reference to FIGS. 1–3, placement of notches 64 in the sidepanels adjacent back panels 16 detracts little from the overall aesthetic appearance of the rack structure. Indeed, tabs 62 fill associated notches in such manner as to be barely discernible. Even the unused outside notches, by reason of their small size, are barely discerniable.

Notches 64 are dimensioned to fully receive tabs 62. The tab, itself, may advantageously be of similar cross-section to that of the spline 22. As illustrated in FIGS. 4 and 5, tab 62 is preferably molded as an extension of spline 22 thereby permitting the molding of these two components as a single piece. A transverse recess or score line 66 is provided in the molded tab/spline piece thereby facilitating the subsequent manual separation of these components during rack assembly.

Figure 7:
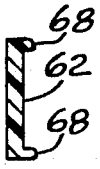
FIG. 7 is a sectional view of the tab member taken along line 7—7 of FIG. 4.

Tab 62, as further shown in FIG. 7, includes a pair of opposed wings 68. Wings 68 are preferably spaced apart a distance equal to, or slightly greater than, the thickness of the two side panels 12 and 14 whereby the tab wings serve to retain the sidepanels of adjacent racks in abutting engagement.

The tab should have sufficient thickness to preclude shearing or other deformation during use of the rack system. As previously noted, however, the tab may advantageously be molded simultaneously with the spline and consequently it would have a similar cross-section thereto. The tab can be made sufficiently long to assure adequate strength, for example, about ½ inch for the present rack.

The depth of notch 64 is selected to be substantially identical to the length of the tab. The width of the notch, however, may be slightly narrower than the corresponding thickness of the tab to facilitate the friction retention of the tab upon insertion into the notches.

The cooperative interaction of the slot/spline 21 and the notch/tab 60 mechanisms is as follows. A pair of magazine racks 10, each having a pair of parallel slots 20 integrally formed on the respective base panels are interconnected with a pair of splines 22. More specifically, each spline is first inserted into a slot 20 of a first rack 10 until a firm friction fit is obtained or until said spline becomes wedged in the constricted portion 31 of the slot. Approximately half of each spline remains protruding from its respective slot. The protruding splines are aligned with the corresponding parallel slots of a second magazine rack and inserted into said slots until the contiguous side panels of the magazine racks are in abutting engagement.

The interconnection of the lower spline/slots provides a measure of rigidity between the attached racks, at least, along the fore/aft and vertical up/down axes. However, they remain unstable and subject to relative torsional movement of the upper portions of the racks either laterally or apart. It will be appreciated that such interconnection, while adequate for some applications, does not provide the requisite multi-axis stability for a rack system intended for use in any of three independent orthogonal directions.

The destabilization or deformation caused by the above described torsional forces is effectively overcome by the further attachment of the tab/slot mechanism 60, in particular, by the insertion of tabs 62 into slots 64 at the junction of each rack pair. The cooperation of the slot/spline and notch/tab arrangements, therefore, provides a stable, in three dimensions, interconnecting arrangement necessary to a multiple use rack/tray system.

I claim:

1. A magazine or paper storage system for holding magazines, papers or similar sheet material selectively in one of three orthogonal orientations, the three orientations including a first orientation for retaining magazines in a flat horizontal manner, and second and third orientations for maintaining magazines in a vertical manner with the top or side of each magazine being oriented respectively upwardly for said second and third orientations; the storage system comprising a plurality of rack means and means for interconnecting the rack means thereby to define a unitary storage system, the physical size of the storage system increasing with the number of interconnected rack means defining the system; each rack means including first and second sides and integral means for rigidly maintaining said sides in spaced apart generally parallel relationship thereby forming a region for magazines generally defined between said sides, the first side including means for supporting magazines and serving as the bottom of the rack means when the storage system is in the first orientation, the second side having an opening therein to permit viewing of magazines in the rack means and to facilitate placement or removal of magazines from the rack means the means for interconnecting the rack means includes a plurality of coupling means spaced generally at the perimeter of the first and second sides of each rack means for retaining the first side of one rack means in abutting adjacent relationship to the second side of another rack means thereby constraining the interconnected rack means against lineal or torsional movement therebetween, whereby a system for storing magazines in any of three orientations and having any predetermined number of separate magazine storage regions can be achieved.

2. A magazine or paper storage system for holding magazines, papers or similar sheet material; the storage system comprising a plurality of rack means and means for interconnecting the rack means thereby to define a unitary storage system, the physical size of the storage system increasing with the number of interconnected rack means defining the system; each rack means including first and second sides and integral means for rigidly maintaining said sides in spaced apart generally parallel relationship thereby forming a region for magazines generally defined between said sides, the rack interconnecting means including a plurality of coupling means for retaining the first side of one rack means in abutting adjacent relationship to the second side of another rack means, the coupling means being spaced generally around the perimeter of said first and second side means whereby the interconnected rack means are constrained against lineal or torsional movement therebetween; the means for rigidity maintaining the sides in spaced apart relationship includes a third sale and wherein the coupling means includes at least one pair of slots integrally formed on the third side of each rack means, one of said pair of slots being oriented adjacent to the first side and the other of the pair of slots being oriented adjacent to the second side; spline means for insertion into said slots whereby the spline means may be inserted into the corresponding slots of the adjacent rack means thereby serving to retain the first side of one rack means in abutting adjacent relationship to the second side of another rack means.

3. The magazine or paper storage system of claim 2 in which the each slot includes surface means for receiving frictional engagement of the spline means and ridge means for biasing the spline means into frictional engagement with the slot surface means whereby the spline is frictionally held within the slot means.

4. The magazine or paper storage system of claim 3 in which the frictional engagement surface means of the slot means defines spaced apart first and second friction semi-surfaces and in which the ridge means is spaced between said semi-surfaces whereby the ridge means biases the spline means into contact with the slot means at said respective first and second semi-surfaces.

5. The magazine or paper storage system of claim 4 in which the spline means is comprised of a deformable material whereby the spline means may be deformed by the ridge means upon biasing of the spline means against the respective first and second slot semi-surfaces thereby assuring frictional engagement of spline means without regard to the dimensional accuracy of the slot and spline means.

6. The magazine or paper storage system of claim 3 in which the spacing between the ridge means and the slot friction engagement surface means is contoured whereby the frictional resistance to movement of the spline means within the slot can be correspondingly contoured to assure proper spline means insertion and retention.

7. A magazine or paper storage system for holding magazine, papers or similar sheet material; the storage system comprising a plurality of rack means and means for interconnecting the rack means thereby to define a unitary storage system, the physical size of the storage system increasing with the number of interconnected rack means defining the system; each rack means including first and second sides and integral means for rigidly maintaining said sides in spaced apart generally parallel relationship thereby forming a region for magazines generally defined between said sides, the rack interconnecting means including a plurality of coupling means for retaining the first side of one rack means in abutting adjacent relationship to the second side of another rack means, the coupling means being spaced generally around the perimeter of said first and second side means whereby the interconnected rack means are constrained against lineal or torsional movement therebetween; wherein the coupling means includes notch means in each of the first and second sides and means operably associated with the notch means for engaging and locking in abutting contact said sides of respective adjacent rack means.

8. A magazine or paper storage system for holding magazines, papers or similar sheet material; the storage system comprising a plurality of rack means and means for interconnecting the rack means thereby to define a unitary storage system, the physical size of the storage system increasing with the number of interconnected rack means defining the system; each rack means including first and second sides and integral means for rigidly maintaining said sides in spaced apart generally parallel relationship thereby forming a region for magazines generally defined between said sides, the rack interconnecting means including a plurality of coupling means for retaining the first side of one rack means in abutting adjacent relationship to the second side of another rack means, the coupling means being spaced generally around the perimeter of said first and second side means whereby the interconnected rack means are constrained against lineal or torsional movement therebetween; wherein the coupling means includes notch means in each of the first and second sides and winged tab means for engaging and locking respective first and second sides of adjacent rack means in adjacent abutting contact, the winged tab including a body portion for insertion into the notch means of adjacent rack means and a pair of integral tab members formed at substantially right angles to the body portion at the ends thereof whereby the body portion of the winged tab secures the adjacent rack means against relative torsional movement therebetween and the tab members secure the rack means against parting lineal movement.

* * * * *